United States Patent [19]

Williams et al.

[11] Patent Number: 4,941,387

[45] Date of Patent: Jul. 17, 1990

[54] METHOD AND APPARATUS FOR INTELLIGENT CHORD ACCOMPANIMENT

[75] Inventors: Anthony G. Williams; David T. Starkey, both of San Diego, Calif.

[73] Assignee: Gulbransen, Incorporated, San Diego, Calif.

[21] Appl. No.: 145,093

[22] Filed: Jan. 19, 1988

[51] Int. Cl.[5] ..... G10H 7/00

[52] U.S. Cl. ..... 84/609; 84/619

[58] Field of Search ..... 84/1.28, 445, DIG. 22, 84/DIG. 23, DIG. 30, 1.01, 1.03, 1.17, 609–614, 619, 639–643

[56] References Cited

U.S. PATENT DOCUMENTS

| | | | |
|---|---|---|---|
| 4,129,055 | 12/1978 | Whittington et al. | 84/1.01 |
| 4,179,968 | 12/1979 | Suzuki | 84/1.01 |
| 4,248,118 | 2/1981 | Hall | 84/1.01 |
| 4,282,786 | 8/1981 | Deutsch et al. | 84/1.01 |
| 4,292,874 | 10/1981 | Jones et al. | 84/1.03 |
| 4,300,430 | 11/1981 | Bione et al. | 84/1.01 |
| 4,311,077 | 1/1982 | Hall | 84/1.03 |
| 4,339,978 | 7/1983 | Imamura | 84/1.03 |
| 4,381,689 | 5/1983 | Oya | 84/1.01 |
| 4,387,618 | 6/1983 | Simmons, Jr. | 84/1.03 |
| 4,406,203 | 9/1983 | Okamoto et al. | 84/1.28 X |
| 4,467,689 | 8/1984 | Stier et al. | 84/1.03 |
| 4,468,998 | 9/1984 | Baggi | 84/1.03 |
| 4,470,332 | 9/1984 | Aoki | 84/1.03 |
| 4,489,636 | 12/1984 | Aoki et al. | 84/1.01 |
| 4,499,808 | 2/1985 | Aoki | 84/1.03 |
| 4,508,002 | 4/1985 | Hall et al. | 84/1.03 |
| 4,519,286 | 5/1985 | Hall et al. | 84/1.03 |
| 4,520,707 | 6/1985 | Weil, Jr. et al. | 84/1.03 |
| 4,539,882 | 9/1985 | Yuzawa | 84/1.03 |
| 4,561,338 | 12/1985 | Ohno | 84/1.03 |
| 4,602,545 | 7/1986 | Starkey | 84/1.01 |
| 4,619,176 | 10/1986 | Isii | 84/1.03 |
| 4,630,517 | 12/1986 | Hall et al. | 84/1.01 |
| 4,664,010 | 3/1987 | Sestero | 84/445 X |
| 4,681,008 | 7/1987 | Morikawa et al. | 84/1.28 |

*Primary Examiner*—Stanley J. Witkowski
*Attorney, Agent, or Firm*—J. R. Penrod

[57] ABSTRACT

A digital synthesizer type electronic musical instrument that has the ability to automatically accompany a prerecorded song with appropriate chords. The prerecorded song is transposed into the key of C major, divided into a number of musical sequences, and then stored in a data structure. By analyzing the data structure of each musical sequence, the electronic musical instrument also can provide intelligent accompaniment, such as voice leading, to the notes that the operator plays on the keyboard.

3 Claims, 6 Drawing Sheets

*FIG. 4*

| SEQUENCE DATA STRUCTURE |
| --- |
| • DATA OFFSET<br>• TIME SIGNATURE<br>• NUMBER OF MEASURES<br>• TIME CLICKS (1/96 BEAT) PER MEASURE<br>• TOTAL NUMBER OF CLICKS<br>• REGONITION PROGRAM<br>• RESOLVER PROGRAM<br>• TRANSPOSITION MASK<br>• FILL MASK |

METHOD AND APPARATUS FOR INTELLIGENT CHORD ACCOMPANIMENT

BACKGROUND OF THE INVENTION

This invention relates to electronic musical instruments, and more particularly to a method and apparatus for providing an intelligent accompaniment in electronic musical instruments.

There are many known ways of providing an accompaniment on an electronic musical instrument. U.S. Pat. No. 4,292,874 issued to Jones et al., discloses an automatic control apparatus for the playing of chords and sequences. The apparatus according to Jones et al. stores all of the rhythm accompaniment patterns which are available for use by the instrument and uses a selection algorithm for always selecting a corresponding chord at a fixed tonal distance to each respective note. Thus, the chord accompaniment is always following the melody or solo notes. An accompaniment that always follows the melody notes in chords of a fixed tonal distance creates a "canned" type of musical performance which is not as pleasurable to the listener as music which has a more varied accompaniment.

Another electronic musical instrument is known from U.S. Pat. No. 4,470,332 issued to Aoki. This known instrument generates a counter melody accompaniment from a predetermined pattern of counter melody chords. This instrument recognizes chords as they are played along with the melody notes and uses these recognised chords in the generation of its counter melody accompaniment. The counter melody approach used is more varied than the one known from Jones et al. mentioned above because the chords selected depend upon a preselected progression of either: up to a highest set root note then down to a lowest set root note etc., or up for a selected number of beats with the root note and its respective accompaniment chord and then down for a selected number of beats with the root note and its respective accompaniment chords. Although this is more varied than the performance of the musical instrument of Jones et al., the performance still has a "canned" sound to it.

Another electronic musical instrument is known from U.S. Pat. No. 4,519,286 issued to Hall et al. This known instrument generates a complex accompaniment according to one of a number of chosen styles including country piano, banjo, and accordion. The style is selected beforehand so the instrument knows which data table to take the accompaniment from. These style variations of the accompaniment exploit the use of delayed accompaniment chords in order to achieve the varied accompaniment. Although the style introduces variety, there is still a one-to-one correlation between the melody note played and the accompaniment chord played in the chosen style. Therefore, to some extent, there is still a "canned" quality to the performance since the accompaniment is still responding to the played keys is a set pattern.

SUMMARY OF THE INVENTION

Briefly stated, in accordance with one aspect of the invention, a method is provided for providing a musical performance by an electronic musical instrument including the steps of pre-recording a song having a plurality of sequences each having at least one note therein by transposing the plurality of sequences into the key of C major, and organizing the pre-recorded plurality of transposed sequences into a song data structure for play back by the electronic musical instrument. The song data structure has a header portion, an introductory sequence portion, a normal musical sequence portion, and an ending sequence portion. The musical performance is provided from the pre-recorded data structure by the steps of reading the status information stored in the header portion of the data structure, proceeding to the next in line sequence which then becomes the current sequence, getting the current time command from the current sequence header, and determining if the time to execute the current command has arrived. If the time for the current command has not arrived, the method branches back to the previous step, and if the time for the current command has arrived, the method continues to the next step. Next, the method fetches any event occurring during this current time, and also fetches any control command sequenced during this current time. Determining if the event track is active during this current time, and if it is not active, then returning to the step of fetching the current time command, but if it is active, then continuing to the next step. The next step determines if the current track-resolve flag is active. If it is not active, then the method forwards the pre-recorded note data for direct processing into the corresponding musical note. If, on the other hand, the track-resolve flag is active, then the method selects a resolver specified in the current sequence header, resolves the note event into note data and processes the note data into a corresponding audible note.

BRIEF DESCRIPTION OF THE DRAWINGS

While the specification concludes with claims particularly pointing out and distinctly claiming the subject matter which is considered to be the invention, it is believed that the description will be better understood when taken in conjunction with the following drawings in which:

FIG. 4 illustrates the data entries within each sequence of a pre-recorded song.

DETAILED DESCRIPTION

Figure 1:
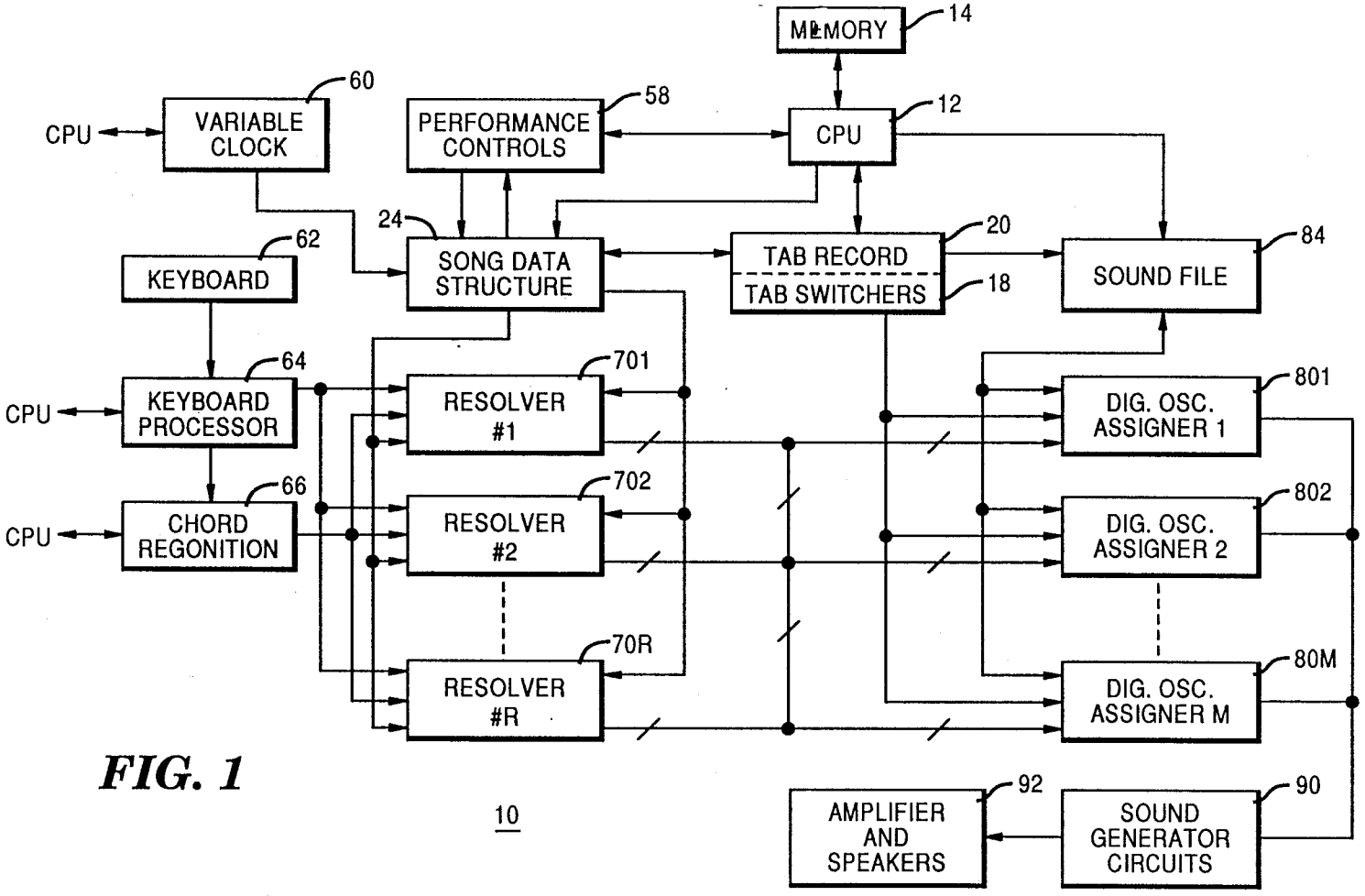
FIG. 1 is a block diagram of an embodiment of the electronic musical instrument.

Referring now to FIG. 1, there is illustrated an electronic musical instrument 10. The instrument 10 is of the digital synthesis type as known from U.S. Pat. No. 4,602,545 issued to Starkey which is hereby incorporated by reference. Further, the instrument 10 is related to the instrument described in the inventors' copending patent application, Ser. No. 07/145,094 entitled "Reassignment of Digital Oscillators According to Amplitude" which is commonly assigned to the assignee of the present invention, which is also hereby incorporate by reference.

Digital synthesizers, such as the instrument 10, typically use a central processing unit (CPU) 12 to control the logical steps for carrying out a digital synthesizing process. The CPU 12, such as a 80186 microprocessor manufactured by the Intel Corporation, follows the instructions of a computer program, the relevant portions of which are included in Appendix A of this specification. This program may be stored in a memory 14 such as ROM, RAM, or a combination of both.

In the instrument 10, the memory 14 stores the pre-recorded song data in addition to the other control processes normally associated with digital synthesizers. Each song is pre-processed by transposing the melody and all of the chords in the original song into the key of C-major as it is recorded. By transposing the notes and chords into the key of C-major, a compact, fixed data record format can be used to keep the amount of data storage required for the song low. Further discussion of the pre-recorded song data will be given later.

The electronic musical instrument 10 has a number of tab switches 18 which provide initial settings for tab data records 20 stored in readable and writable memory, such as RAM. Some of the tab switches select the voice of the instrument 10 much like the stops on a pipe organ, and other tab switches select the style in which the music is performed, such as jazz, country, or blues etc. The initial settings of the tab switches 18 are read by the CPU 12 and written into the tab records 20. Since the tab records 20 are written into by the CPU 12 initially, it will be understood that they can also be changed dynamically by the CPU 12 without a change of the tab switches 18, if so instructed. The tab record 20, as will be explained below, is one of the determining factors of what type of musical sound and performance is ultimately provided.

A second determining factor of the type of musical sound and performance is ultimately provided, is the song data structure 24. The song data structure 24 is likewise stored in a readable and writable memory such as RAM. The song data structure 24 is loaded with one of the pre-recorded songs described previously.

Figure 2:
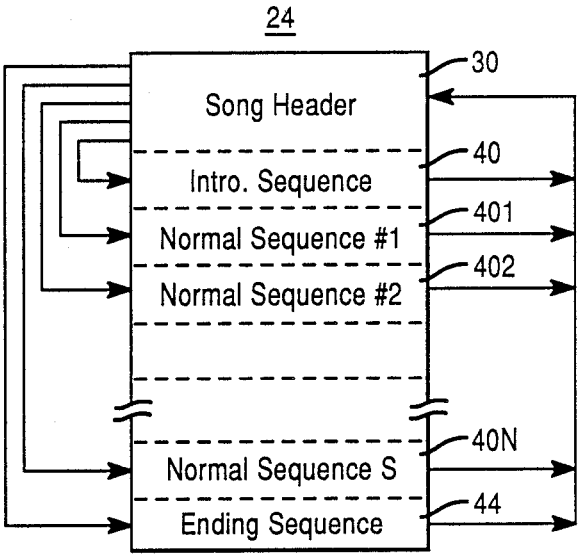
FIG. 2 is a diagram of the data structure of a pre-recorded song.

Referring now to FIG. 2, the details of the song data structure 24 are illustrated. Each song data structure has a song header file 30 in which initial values, such as the name of the song, and the pointers to each of the sequence files 40, 401 through 40N and 44 are stored. The song header 30 typically starts a song loop by accessing an introductory sequence 40, details of which will be discussed later, and proceeds through each part of the introductory sequence 30 until the end thereof has been reached, at which point that part of the song loop is over and the song header 30 starts the next song loop by accessing the next sequence, in this case normal sequence 401. The usual procedure is to loop through each sequence until the ending sequence has been completed, but the song header 30 may contain control data such as loop control events, which alter the normal progression of sequences based upon all inputs to the instrument 10.

Figure 3:
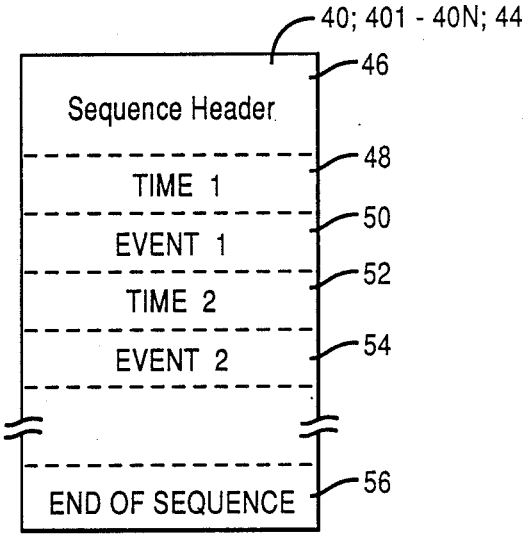
FIG. 3 illustrates the data structure of a sequence within the pre-recorded song.

Referring now to FIGS. 3 and 4, the structure of each sequence file 40, 401 through 40N, and 44 is illustrated. Each sequence has a sequence header 46 which contains the initial tab selection data, and initial performance control data such as resolver selection, initial track assignment, muting mask data, and resolving mask data. The data in each sequence 40, 401–40N, and 44; contains the information for at least one measure of the pre-recorded song. Time 1 is the time measured, in integer multiples of one ninety-sixth (1/96) of the beat of the song, for the playing of a first event 50. This event may be a melody note or a combination of notes or a chord (a chord being a combination of notes with a harmonious relationship among the notes). The event could also be a control event, such as data for changing the characteristics of a note, for example, changing its timbral characteristics. Each time interval is counted out and each event is processed (if not changed or inhibited as will be discussed later) until the end of sequence data 56 is reached, at which point the sequence will loop back to the song header 30 (see FIG. 2) to finish the present sequence and prepare to start the next sequence.

Referring back now to FIG. 1, the remaining elements of the instrument 10 will be discussed. The CPU 12 sets performance controls 58 provide one way of controlling the playing back of the pre-recorded song. The performance controls 58 can mute any track in the song data structure 24, as will be explained later. A variable clock supplies signals which provide for the one ninety-sixth divisions of each song beat into the song structure 24 and into each sequence 40, 401–40N, and 44. The variable clock rate may be changed under the control of CPU 12 in a known way.

Thus far, the pre-recorded song and the tab record 20 have provided the inputs for producing music from the instrument 10. A third input is provided by the key board 62. Although it is possible to have the pre-recorded song play back completely automatically, a more interesting performance is produced by having an operator also providing musical inputs in addition to the pre-recorded data. The keyboard 62 can be from any one of a number of known keyboard designs generating note and chord information through switch closures. The keyboard processor turns the switch closures, and openings into new note(s), sustained note(s), and released note(s) digital data. This digital data is passed to a chord recognition device 66. The chord recognition process used in the preferred embodiment of the chord recognition device 66 is given in appendix A. Out of the chord recognition device 66 comes data representing the recognized chords. The chord recognition device 66 is typically a section of RAM operated by a CPU and a control program. There may be more than one chord recognition program in which case each sequence header 40, 401–40N, and 44; has chord recognition select data which selects the program used for that sequence.

The information output of the keyboard processor 64 is also connected to each of the resolvers 701–70R as an input, along with the information output from the chord recognition device 66 and the information output from the song data structure 24. Each resolver represents a type or style of music. The resolver defines what types of harmonies are allowable within chords, and between melody notes and accompanying chords. The resolvers can use Dorian, Aeolian, harmonic, blues or other known chord note selection rules. The resolver program used by the preferred embodiment is given in appendix A.

The resolvers 701–7OR receive inputs from the song data structure 24, which is pre-recorded in the key of C-major; the keyboard processor 64, and the chord recognition device 66. The resolver transposes the notes and chords from the pre-recorded song into the operator selected root note and chord type, both of which are determined by the chord recognition device 66, chord type which is determined by the chord recognition device 66, in order to have automatic accompaniment and automatic fill while still allowing the operator to play the song also. The resolver can also use non-chordal information from the keyboard processor 64, such as passing tones, appogiatura, etc. In this manner, the resolver is the point where the operator input and the pre-recorded song input become inter-active to produce a more interesting, yet more musically correct (according to known music theory) performance. Since there can be a separate resolver assigned to each track, the resolver can use voice leading techniques and limit the note value transposition.

Besides the note and chord information, the resolvers also receive time information from the keyboard processor 64, the chord recognition device 66, and the song data structure 24. This timing will be discussed below in conjunction with FIG. 5.

The output of each resolver is assigned to a digital oscillator assignor 801–80M which then performs the digital synthesis processes described in applicants' copending patent application entitled "Reassignment of Digital Oscillators According to Amplitude" in order to produce, ultimately a musical output from the amplifiers and speakers 92. The combination of a resolver 701–70R, a digital oscillator assignor 801–80M, and the digital oscillators (not shown) form a 'track' through which notes and/or chords are processed. The track is initialized by the song data structure 24, and operated by the inputting of time signals, control event signals and note event signals into the respective resolver of each track.

Figure 5:
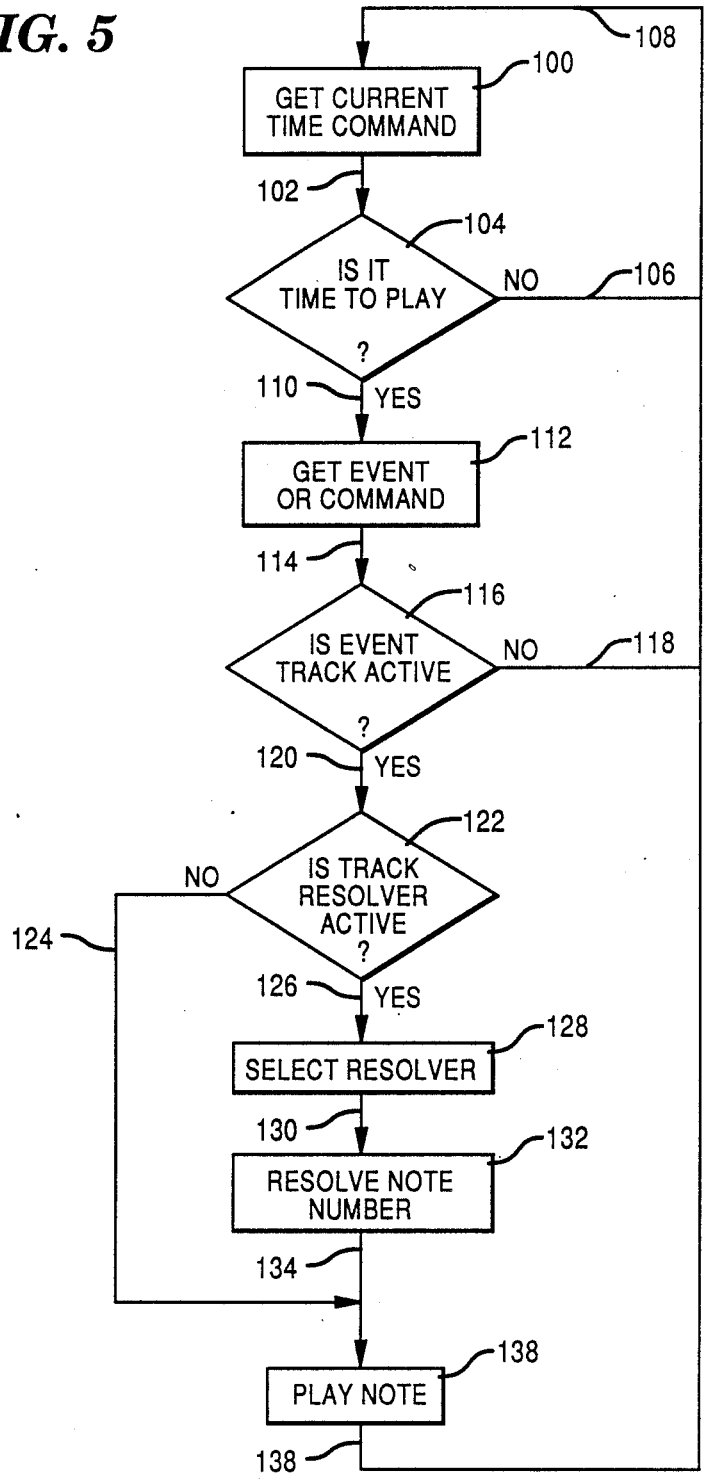
FIG. 5 is a logic flow diagram illustrating the logic processes followed within each sequence.

Referring now to FIG. 5, the operation of a track according to a sequence is illustrated. The action at 100 accesses the current time for the next event, which is referenced to the beginning of the sequence, and then the operation follows path 102 to the action at 104. The action at 104 determines if the time to 'play' the next event has arrived yet, if it has not the operation loops back along path 106,108 to the action at 100. If the action at 104 determines that the time has arrived to 'play' the next event then the operation follows path 110 to the action at 112. The action at 112 accesses the next sequential event from the current sequence and follows path 114 to the action at 116. It should be remembered that the event can either be note data or it can be control data. The remaining discussion considers only the process of playing a musical note since controlling processes by the use of muting masks or by setting flags in general is known. The action at 116 determines if the track for this note event is active (i.e. has it been inhibited by a control signal or event) and if it is not active then it does not process the current event and branches back along path 118,108 to the action at 100. If, however, the action at 116 determines that the event track is active, then the operation follows the path 120 to the action at 122. At 122, a determination is made if the resolver of the active track is active and ready to resolve the note event data. If the resolver is not active the operation follows the path 124,134 to the action at 136, which will be discussed below. If at 122 the resolver is found to be not active, that means that the notes and/or chords do not have to be resolved or transposed and therefore can be played without further processing. If at 122 the resolver track is found to be active, the operation follows the path 126 to the action at 128. The resolver track active determination means that the current event note and/or chord needs to be resolved and/or transposed. The action at 128 selects the resolver which is to be used for resolving and/or transposing the note or chord corresponding to the event. The resolver for each sequence within the pre-recorded song is chosen during play back. After the resolver has been selected at 128, the operation follows path 130 to the action at 132. The action at 132 resolves the events into note numbers which are then applied to the sound file 84 (see FIG. 1) to obtain the digital synthesis information and follows path 134 to the action at 136. The action at 136 which plays the note or chord. In the preferred embodiment, the note or chord is played by connecting the digital synthesis information to at least one digital oscillator assigner 801–80M which then assigns the information to sound generator 90 (see FIG. 1). The operation then follows the path 138,108 to the action at 100 to start the operation for playing the next part of the sequence.

Thus, there has been described a new method and apparatus for providing an intelligent automatic accompaniment in an electronic musical instrument. It is contemplated that other variations and modifications of the method and apparatus of applicants' invention will occur to those skilled in the art. All such variations and modification which fall within the spirit and scope of the appended claims are deemed to be part of the present invention.

APPENDIX A

OF

METHOD AND APPARATUS FOR INTELLIGENT CHORD ACCOMPANIMENT

Sequencer Description:

This file briefly describes the operation of the Gulbransen Digital Piano sequencer.

The sequencer is designed to operate on both ROM-based and disk-based instruments. It is designed to be a core sequencer applicable to forseeable future products, including pro-market products.

Its basic structure is that of a 16-song, 16-track tape recorder. Real-time changing from song to song is supported. When a song is selected, it is played from measure-relative time from the beginning of the song. In other words, if song #1 is playing and song #2 is selected on beat 2 of the measure, song #2 will start playing at beat 2 of its starting measure.

The sequencer also has provisions for special musical segments called intro, fill, and ending. These are special musical segments specified by the user or the rhythm designer. They are played depending at certain user controlled times. See Panel Controls of the Gulbransen Digital Piano for further details.

Buffers:

The following data buffers are allocated at load time for each of the 16 songs:

Intro (1 sector).
Fill (1 sector).
End (1 sector).
Start (4 sectors for each sequence in the song).

The following data buffers are allocated at load time:

Control Changes for each of 16 tracks (max 8 control changes, 384 bytes total).
Play (2 sectors).

Load Operation:

Load directory (disk Track/Sector lists).
Load Start buffer (1024 bytes x 16).
Allocate 2-sector Play buffer (512 bytes).
Allocate 16 Control Changes buffer (576 bytes).

Song select (from start):

Fill Play buffer with selected rhythm.
Set 16-bit tracks status.
Fill Control Changes buffer with initial control changes from beginning of Start buffer.

Acc/Var select/deselect:

Update 16-bit tracks status.
If selecting, send out Control Changes buffer for that track.

Play Operation:

If Intro selected, simulate Intro.
Start outputting Start buffer.
Move subsequent data sectors into Play buffer.
Play active tracks.
Update Control Changes buffer for all tracks (even if inactive)

Song Change (from one to another):

Fill Play buffer with selected rhythm.
Sift to corresponding measure-relative time in appropriate Start buffer.
While sifting, update Control Changes buffer and if active, output.

Fill select:

Start outputting Fill buffer.
Move subsequent data sectors into Play buffer.
Play active tracks.
Update Control Changes buffer for all tracks (even if inactive).

Intro select:

Start outputting Intro buffer.
Move subsequent data sectors into Play buffer.
Play active tracks.
Update Control Changes buffer for all tracks (even if inactive).

End select:

Start outputting End buffer.
Move subsequent data sectors into Play buffer.
Play active tracks.
Update Control Changes buffer for all tracks (even if inactive).

```
/* CHORDRCG.C */

/* (c) Copyright 1988 Gulbransen, Inc. */

/* This is an example of a chord recognition device specified in the
   sequence header data structure.   The main entry point is the
   last function, chord_rcg().  */



/* Recognized chords:

Triad          Major       Minor       Diminished    Augmented     Suspended
               CEG         CEbG        CEbGb         CEG#          CFG

Maj6           C6          Cm6         C-7
Maj6 Maj9      C69
Min7           C7          Cm7         Cm7b5         C+7           C7sus
Min7 No 5th    C7          Cm7                                     C7sus
Min7 Maj6      C13
Min7 Min9      C7b9        Cm7b9       C-7b9         C+7b9
Min7 Maj9      C9          Cm9         C-9           C+9           C9sus
Min7 Aug9      C7#9
Maj7           CM7         CmM7        C-M7          C+M7          CM7sus
Maj7 Maj9      CM9
Maj7 No 5th    CM7         CM7

*/


/*

                undefined                          Triad Type
Type word       ---------                          -------------
Bit number:     FEDC        B  A  9  8  7  6  5    4  3  2  1  0

                            N  A  M  m  M  m  M    s  d  a  m  m
                            1  9  9  9  7  7  6    u  i  u  i  a
                            1                      s  m  g  n  j
                                                   p  i  m  o  o
                                                   e  n  e  r  r
                                                   n  i  n
                                                   d  s  t
                                                   e  h  e
                                                   d     d

*/


/* intervals */

#define UNISON      0
#define m2          1
#define M2          2
#define m3          3
#define M3          4
#define P4          5
#define d5          6
#define P5          7
#define A5          8
#define m6          8
#define M6          9
#define d7          9
#define m7         10
#define M7         11
#define m9          1
#define M9          2
#define A9          3
#define M11         5

/* triad types */

#define TRIAD      0x001F
#define MAJOR      0x0001
```

```
76  #define MINOR        0x0002
77  #define AUGMENTED    0x0004
78  #define DIMINISHED   0x0008
79  #define SUSPENDED    0x0010
80
81  /* extensions */
82
83  #define MAJ6         0x0020
84  #define DIM7         MAJ6
85
86  #define MIN7         0x0040
87  #define MAJ7         0x0080
88
89  #define MIN9         0x0100
90  #define MAJ9         0x0200
91  #define AUG9         0x0400
92
93  #define MAT11        0x0800
94
95
96  /* harmony types */
97
98  #define TERTIAN      3
99  #define QUARTAL      4
100
101 #define NONE         0xFF
102
103 /* no chord */
104 #define NC           12
105
106 /* used for LED display */
107 #if STAND_ALONE
108 #define FLAT         'b'
109 #elif INTEGRATED
110 #define FLAT         0x16
111 #endif
112
113 #define SF_LOWEST    0x30
114
115
116 #define NUM_NOTES      128
117 #define MIDDLE_C      0x3C
118 #define OCTAVE          12
119
120
121
122 /*<f>*/
123
124
125 typedef unsigned char byte;
126 typedef int bool;
127
128
129 /* Global variables maintained by this module */
130
131    byte tonic = NC;          /* root of chord */
132    unsigned int chord_type;  /* determined by chordrcg() */
133
134    bool chord_memory;
135    byte chord_notes [NUM_NOTES];
136    int num_chord_notes = 0;
137
138    byte div_12 [NUM_NOTES] = {
139       0,0,0,0,0,0,0,0,0,0,0,0,
140       1,1,1,1,1,1,1,1,1,1,1,1,
141       2,2,2,2,2,2,2,2,2,2,2,2,
142       3,3,3,3,3,3,3,3,3,3,3,3,
143       4,4,4,4,4,4,4,4,4,4,4,4,
144       5,5,5,5,5,5,5,5,5,5,5,5,
145       6,6,6,6,6,6,6,6,6,6,6,6,
146       7,7,7,7,7,7,7,7,7,7,7,7,
147       8,8,8,8,8,8,8,8,8,8,8,8,
148       9,9,9,9,9,9,9,9,9,9,9,9,
149       10,10,10,10,10,10,10,10
150       };
151
```

```
152     byte mod_12 [NUM_NOTES] = {
153        0,1,2,3,4,5,6,7,8,9,10,11,
154        0,1,2,3,4,5,6,7,8,9,10,11,
155        0,1,2,3,4,5,6,7,8,9,10,11,
156        0,1,2,3,4,5,6,7,8,9,10,11,
157        0,1,2,3,4,5,6,7,8,9,10,11,
158        0,1,2,3,4,5,6,7,8,9,10,11,
159        0,1,2,3,4,5,6,7,8,9,10,11,
160        0,1,2,3,4,5,6,7,8,9,10,11,
161        0,1,2,3,4,5,6,7,8,9,10,11,
162        0,1,2,3,4,5,6,7,8,9,10,11,
163        0,1,2,3,4,5,6,7
164        };
165
166
167
168
169  /* Local variables */
170
171
172     static unsigned int type; /* chord type */
173
174     static byte num_intvs;
175     static byte num_notes;
176
177     struct nt {
178        byte num;
179        byte link;
180        byte parent;
181        byte intv; /* interval to next note in chord */
182        };
183     static struct nt notes[16]; /* array of notes down.  Actually only 12
184                                    notes are needed, but we pad to a power
185                                    of 2 for access efficiency. */
186
187
188
189
190  /*<f>*/
191
192
193  /* Function to check for cyclicity of chord.  Returns TRUE if cyclic. */
194
195  bool cyclic(c,n)
196     byte c, n;
197     {
198     byte i;
199     byte par;
200
201     for (i=0; ((par = notes[c].parent) != n) && (par != NONE) && (i < num_notes); i++)
202        c = par;
203
204     if (notes[c].parent == n) return (TRUE);
205     else return (FALSE);
206     }
207
208
209
210  /* Function to quickly compute interval from note #1 to note #2 within
211     an octave */
212
213  byte get_intv(note1, note2)
214     byte note1, note2;
215     {
216     int temp;
217
218     if ((temp = (note2-note1)) < 0) {
219        if ((temp = mod_12 [note1-note2]) > 0)
220           return ((byte)(OCTAVE- (mod_12[temp])));
221        else return ((byte)temp);
222        }
223     else return ((byte)(mod_12[temp]));
224     }
225
226
227
```

```
228 /* Try to build a chord, given the type of harmony */
229
230 byte chord_build(harmony)
231    byte harmony;
232    {
233    byte _tonic;
234    bool good_intv;
235    bool done;
236    int i;
237    byte current,next;
238    byte intv;
239    byte par;
240
241    /* stack tones into specified intervals */
242
243    /* init */
244    _tonic = NONE;
245    num_intvs = 0;
246    for (i=0; i<num_notes; i++)
247       notes[i].link = notes[i].parent = NONE;
248
249    for (current=0; current<num_notes; current++) {
250       next = (current+1) % num_notes;
251       done = FALSE;
252
253       while (!done) {
254          if (notes[next].parent == NONE) {
255
256             /* get interval from current to next (within octave) */
257             intv = get_intv (notes[current].num, notes[next].num);
258
259             /* different conditions for different harmonies */
260             if (harmony == TERTIAN)
261                good_intv = (intv == m3) || (intv == M3);
262             else if (harmony == QUARTAL)
263                good_intv = (intv == P4);
264
265             /* check for correct interval */
266             if (good_intv && !cyclic(current,next)) {
267                notes[next].parent = current;
268                notes[current].link = next; /* "point to" next overtone */
269                notes[current].intv = intv; /* save interval */
270                if ((_tonic == next) || (_tonic == NONE)) /* new _tonic is intv below old _tonic */
271                   _tonic = current;
272                num_intvs++;
273                done = TRUE;
274                }
275             else
276                if (((next = (next+1) % num_notes)) == current)
277                   done = TRUE;
278             }
279          else
280             if (((next = (next+1) % num_notes)) == current)
281                done = TRUE;
282          }
283       }
284
285    /* back track to tonic */
286    for (i=0; (i<num_notes && ((par = notes[_tonic].parent) != NONE)); i++)
287       _tonic = par;
288
289    if (num_intvs > 0)
290       notes[_tonic].parent = _tonic; /* to distinguish from added tone */
291
292    return(_tonic);
293    }
294
295
296
297 /* Function to determine chord type */
298
299 unsigned int type_build(tonic_p)
300    byte *tonic_p;
301    {
302    int i;
303    byte intv1,intv2;
```

```
304     byte next_note;
305     byte temp; /* aux var */
306     byte tonic_note_number;
307
308     /* determine triad type */
309     next_note = *tonic_p;
310     intv1 = notes[next_note].intv;
311     next_note = notes[next_note].link;
312     intv2 = notes[next_note].intv;
313
314     type = 0; /* init */
315
316     if (intv1 == M3) {
317        if (intv2 == M3) type |= AUGMENTED;
318        else if (intv2 == m3) type |= MAJOR;
319        }
320     else {
321        if (intv1 == m3) {
322           if (intv2 == M3) type |= MINOR;
323           else if (intv2 == m3) type |= DIMINISHED;
324           }
325        else if ((intv1 == P4) && (intv2 == P4)) type |= SUSPENDED;
326        }
327
328     /* Special case: suspended chords: adjust tonic */
329
330     if (type == SUSPENDED) {
331        temp = notes[*tonic_p].link; /* save tonic */
332        notes[*tonic_p].link = NONE; /* break chain */
333        *tonic_p = temp; /* assign tonic */
334
335        if (num_intvs > 3) type |= (MIN7 | MAJ9);
336        else if (num_intvs == 3) type |= MIN7;
337        }
338     else { /* get extensions and added tones */
339        tonic_note_number = notes[*tonic_p].num;
340        for (i=0; i<num_notes; i++) {
341           switch (get_intv (tonic_note_number, notes[i].num)) {
342              case M6: type |= MAJ6; break;
343              case m7: type |= MIN7; break;
344              case M7: type |= MAJ7; break;
345              case m9: type |= MIN9; break;
346              case M9: type |= MAJ9; break;
347              case A9:
348                 if (!((type & MINOR) | (type & DIMINISHED))) type |= AUG9;
349                 break;
350              case M11: type |= MAT11; break;
351              }
352           }
353
354        /* some special cases */
355        switch (type) {
356           case (MINOR | MIN7):
357              if (notes[*tonic_p].link == 0) { /* if bottom note is 3rd */
358                 *tonic_p = 0; /* make bass (3rd) new tonic */
359                 type = (MAJOR | MAJ6); /* change to Major6 chord */
360                 }
361              break;
362
363           case (MINOR | MIN7 | MIN9):
364              *tonic_p = notes[*tonic_p].link; /* make 3rd new tonic */
365              type = (MAJOR | MAJ6 | MIN7); /* change to 13 chord */
366              break;
367
368           case (DIMINISHED | MIN7):
369              *tonic_p = notes[*tonic_p].link; /* make 3rd new tonic */
370              type = (MINOR | MAJ6); /* call it Minor 6th chord */
371              break;
372
373           case (DIMINISHED | MAJ6):
374              type = (DIMINISHED | DIM7);
375              break;
376
377           case (MAJOR | MAJ6 | MAJ9): /* special case of sus9 chord */
378              if (get_intv (notes[*tonic_p].num,notes[0].num) == M9) { /* if 9th on bottom */
```

```
379                *tonic_p = 0; /* make bass (9th) new tonic */
380                type = (SUSPENDED | MIN7 | MAJ9); /* change to sus9 chord */
381                }
382             break;
383
384          case (MINOR | MIN7 | MAT11):
385             intv1 = get_intv (notes[*tonic_p].num,notes[0].num);
386             if (intv1 == P4) { /* if 4th on bottom */
387                *tonic_p = 0; /* make bass (4th) new tonic */
388                type = (SUSPENDED | MIN7 | MAJ9); /* change to sus9 chord */
389                }
390             else if ((intv1 == m3) | (intv1 == m7)) { /* if 3th or 7th on bottom */
391                *tonic_p = notes[*tonic_p].link; /* make 3rd new tonic */
392                type = (MAJOR | MAJ6 | MAJ9); /* change to 69 chord */
393                }
394             break;
395          }
396       }
397    return (type);
398    }
399
400
401
402 /*<f>*/
403
404
405 /* Given a 128-element array denoting which keys are down, this function
406    determines the chord type and it's tonic.  It assumes tertian harmony.
407    Returned is a tonic note number between 0 (C) and 11 (B).  This function
408    only uses the notes within the 128-element array which are between the
409    lowest key and the highest key for the left keyboard (given in the key0
410    structure specified in keybd.h).  */
411
412 byte chord_rcg(type_p)
413    unsigned int *type_p;
414    {
415    byte i;
416    byte _tonic;
417    int lo_limit, hi_limit;
418    byte uniq_note [OCTAVE]; /* to avoid duplicate note (names) */
419    byte interval;
420    byte mod_i;
421
422    memset (uniq_note, 0, sizeof(uniq_note)); /* init array */
423
424    lo_limit = key0.lowest + key0.transpose + key0.left.transpose;
425    if (key0.split != 0)
426       hi_limit = key0.split + key0.transpose + key0.left.transpose;
427    else  /* Fully layered keyboard, so assume highest of MIDDLE_C. */
428       hi_limit = MIDDLE_C + key0.transpose + key0.left.transpose;
429
430    /* Clamp lo_limit and hi_limit to 0 and NUM_NOTES-1, respectively */
431    if (lo_limit < 0) lo_limit = 0;
432    else if (lo_limit > NUM_NOTES - 1) lo_limit = NUM_NOTES - 1;
433    if (hi_limit < 0) hi_limit = 0;
434    else if (hi_limit > NUM_NOTES - 1) hi_limit = NUM_NOTES - 1;
435
436    /* build notes down array */
437    num_notes = num_chord_notes = 0;
438    for (i=(byte)lo_limit; i<(byte)hi_limit; i++) {
439       if (key0.left.keydown[i] != 0) {
440          if (uniq_note[mod_i = mod_12[i]] == 0) {
441             notes[num_notes++].num = i;
442             uniq_note [mod_i] = 1;
443             }
444          chord_notes[num_chord_notes++] = i;
445          }
446       }
447
448    /* Recognize two notes a third apart as a triad */
449    if (num_notes < 2) /* minimum chordal unit is triad */
450       return (NC);
451
452    _tonic = chord_build (TERTIAN); /* first try to build a chord by thirds */
453
454    if (num_intvs >= 2) { /* if successful */
```

```
455        *type_p = type_build(&_tonic);
456        return (mod_12 [notes[_tonic].num]);
457        }
458     else {
459        /* Check for special case of 7th chord (major and minor only) w/o 5th */
460        if (num_intvs == 1) {
461           if (num_notes == 3) {
462              for (i=0; i<(byte)num_notes; i++) { /* find seventh if any */
463                 if (notes[i].parent == NONE) { /* if no parent */
464
465                    interval = get_intv(notes[_tonic].num, notes[i].num);
466
467                    if (interval == m7) {
468                       if (notes[_tonic].intv == m3) {
469                          *type_p = (MINOR | MIN7);
470                          return (mod_12 [notes[_tonic].num]);
471                          }
472                       else {
473                          *type_p = (MAJOR | MIN7);
474                          return (mod_12 [notes[_tonic].num]);
475                          }
476                       }
477                    else if (interval == M7) {
478                       if (notes[_tonic].intv == m3) {
479                          *type_p = (MINOR | MAJ7);
480                          return (mod_12 [notes[_tonic].num]);
481                          }
482                       else {
483                          *type_p = (MAJOR | MAJ7);
484                          return (mod_12 [notes[_tonic].num]);
485                          }
486                       }
487                    }
488                 }
489              return (NC);
490              }
491
492           /* Recognize 2 notes that are a third apart as a chord */
493           else if (num_notes == 2) {
494              if (notes[_tonic].intv == m3) {
495                 *type_p = (MINOR);
496                 return (mod_12 [notes[_tonic].num]);
497                 }
498              else {
499                 *type_p = (MAJOR);
500                 return (mod_12 [notes[_tonic].num]);
501                 }
502              }
503           }
504        }
505
506     _tonic = chord_build (QUARTAL); /* try building a chord by fourths */
507     if (num_intvs >= 2) { /* if successful */
508        *type_p = type_build(&_tonic);
509        return (mod_12 [notes[_tonic].num]);
510        }
511     else return (NC);
512     }
513
514
515
516
517
```

```
1  /* RESOLVE.C */
2
3  /* (c) Copyright 1987 Gulbransen, Inc. */
4
5  /* Module to resolve sequence notes to fit chord played by user.  This
6     is a example of the type of resolvers that can be used.  For clarity,
7     these resolvers do not use chord history or non-harmonic note information
8     from the keyboard processor or apply complex voice leading
9     rules to affect the transposition.  In general, all resolvers return an
10    altered note value that harmonizes with a given note value.  Each resolver
11    uses two global variables, tonic and chord_type, from the chord recognizer.  */
```

```
12
13
14 typedef unsigned char byte;
15
16 enum resolve_algorithm {dorian,aeolian,harmonic,blues,no_resolve};
17
18 /* This is the resolver function selection mechanism, an array of function
19    pointers indexed by resolver type (which is stored in the sequence header
20    data structure).  */
21 byte (*resolver [no_resolve])(byte note) =
22      {resolve_dorian,resolve_aeolian,resolve_harmonic,resolve_blues};
23
24
25
26
27
28 /* <ff> */
29
30 byte resolve_dorian(note)
31    byte note;
32    {
33    /* Switch on interval (within an octave) from tonic to note */
34    switch (get_intv(tonic,note)) {
35       case 0: /* C */
36          return(note);
37
38       case 1: /* C# */
39          return(note);
40
41       case 2: /* D */
42          if (chord_type & MIN9) return(note-1);
43          else if (chord_type & AUG9) return(note+1);
44          else return(note);
45
46       case 3: /* Eb */
47          if (((chord_type & MAJOR) || (chord_type & AUGMENTED)) && (chord_type & AUG9))
48             return(note+1);
49          else if (chord_type & SUSPENDED) return(note+2);
50          else return(note);
51
52       case 4: /* E */
53          if ((chord_type & MINOR) || (chord_type & DIMINISHED)) return(note-1);
54          else if (chord_type & SUSPENDED) return(note+1);
55          else return(note);
56
57       case 5: /* F */
58          if (chord_type & AUGMENTED) return(note-1);
59          else return(note);
60
61       case 6: /* F# */
62          return(note);
63
64       case 7: /* G */
65          if (chord_type & DIMINISHED) return(note-1);
66          else if (chord_type & AUGMENTED) return(note+1);
67          return(note);
68
69       case 8: /* Ab */
70          return(note);
71
72       case 9: /* A */
73          if (chord_type & MAJ6) return(note);
74          else if (chord_type & AUGMENTED) return(note+1);
75          else return(note);
76
77       case 10: /* Bb */
78          if (chord_type & MIN7) return(note);
79          else if (chord_type & MAJ7) return(note+1);
80          else if (chord_type & DIMINISHED) return(note-1);
81          return(note);
82
83       case 11: /* B */
84          if (chord_type & MAJ7) return(note);
85          else if (chord_type & MIN7) return(note-1);
86          else if (chord_type & MINOR) return(note-1);
87          else return(note);
```

```
88        }
89     return(note); /* Just in case get_intv() screws up (should never get here) */
90     }
91
92
93  /* <ff> */
94
95  byte resolve_aeolian(note)
96     byte note;
97     {
98     /* Switch on interval (within an octave) from tonic to note */
99     switch (get_intv(tonic,note)) {
100       case (0): /* C */
101          return(note);
102
103       case (1): /* C# */
104          return(note);
105
106       case (2): /* D */
107          else if (chord_type & MIN9) return(note-1);
108          else if (chord_type & AUG9) return(note+1);
109          else return(note);
110
111       case (3): /* Eb */
112          if (((chord_type & MAJOR) || (chord_type & AUGMENTED)) && (chord_type & AUG9))
113             return(note+1);
114          else if (chord_type & SUSPENDED) return(note+2);
115          else return(note);
116
117       case (4): /* E */
118          if ((chord_type & MINOR) || (chord_type & DIMINISHED)) return(note-1);
119          else if (chord_type & SUSPENDED) return(note+1);
120          else return(note);
121
122       case (5): /* F */
123          if (chord_type & AUGMENTED) return(note-1);
124          else return(note);
125
126       case (6): /* F# */
127          return(note);
128
129       case (7): /* G */
130          else if (chord_type & DIMINISHED) return(note-1);
131          else if (chord_type & AUGMENTED) return(note+1);
132          else return(note);
133
134       case (8): /* Ab */
135          return(note);
136
137       case (9): /* A */
138          if (chord_type & MAJ6) return(note);
139          else if (chord_type & MINOR) return(note-1);
140          else if (chord_type & AUGMENTED) return(note+1);
141          else return(note);
142
143       case (10): /* Bb */
144          if (chord_type & MIN7) return(note);
145          else if (chord_type & MAJ7) return(note+1);
146          else if (chord_type & DIMINISHED) return(note-1);
147          else return(note);
148
149       case (11): /* B */
150          if (chord_type & MAJ7) return(note);
151          else if (chord_type & MIN7) return(note-1);
152          else if (chord_type & MINOR) return(note-1);
153          else return(note);
154       }
155    return(note); /* Just in case get_intv() screws up (should never get here) */
156    }
157
158
159  /* <ff> */
160
161  byte resolve_harmonic(note)
162     byte note;
```

```
163     {
164     /* Switch on interval (within an octave) from tonic to note */
165     switch (get_intv(tonic,note)) {
166        case (0): /* C */
167           return(note);
168
169        case (1): /* C# */
170           return(note);
171
172        case (2): /* D */
173           if (chord_type & MIN9) return(note-1);
174           else if (chord_type & AUG9) return(note+1);
175           else return(note);
176
177        case (3): /* Eb */
178           if (((chord_type & MAJOR) || (chord_type & AUGMENTED)) && (chord_type & AUG9))
179              return(note+1);
180           else if (chord_type & SUSPENDED) return(note+2);
181           else return(note);
182
183        case (4): /* E */
184           if ((chord_type & MINOR) || (chord_type & DIMINISHED)) return(note-1);
185           else if (chord_type & SUSPENDED) return(note+1);
186           else return(note);
187
188        case (5): /* F */
189           if (chord_type & AUGMENTED) return(note-1);
190           else return(note);
191
192        case (6): /* F# */
193           return(note);
194
195        case (7): /* G */
196           if (chord_type & DIMINISHED) return(note-1);
197           else if (chord_type & AUGMENTED) return(note+1);
198           else return(note);
199
200        case (8): /* Ab */
201           return(note);
202
203        case (9): /* A */
204           if (chord_type & MAJ6) return(note);
205           else if (chord_type & MINOR) return(note-1);
206           else if (chord_type & AUGMENTED) return(note+1);
207           else return(note);
208
209        case (10): /* Bb */
210           if (chord_type & MIN7) return(note);
211           else if (chord_type & MAJ7) return(note+1);
212           else if (chord_type & MINOR) return(note+1);
213           else if (chord_type & DIMINISHED) return(note-1);
214           else return(note);
215
216        case (11): /* B */
217           if (chord_type & MAJ7) return(note);
218           else if (chord_type & MIN7) return(note-1);
219           else return(note);
220        }
221     return(note); /* Just in case get_intv() screws up (should never get here) */
222     }
223
224
225  /* <ff> */
226
227  byte resolve_blues(note)
228     byte note;
229     {
230     /* Switch on interval (within an octave) from tonic to note */
231     switch (get_intv(tonic,note)) {
232        case (0): /* C */
233           return(note);
234
235        case (1): /* C# */
236           return(note);
237
238        case (2): /* D */
```

```
239          if (chord_type & MIN9) return(note-1);
240          else if (chord_type & AUG9) return(note+1);
241          else return(note);
242
243       case (3): /* Eb */
244          return(note);
245
246       case (4): /* E */
247          if ((chord_type & MINOR) || (chord_type & DIMINISHED))
248             return(note-1);
249          else if (chord_type & SUSPENDED) return(note+1);
250          else return(note);
251
252       case (5): /* F */
253          if (chord_type & AUGMENTED) return(note-1);
254          else return(note);
255
256       case (6): /* F# */
257          return(note);
258
259       case (7): /* G */
260          if (chord_type & DIMINISHED) return(note-1);
261          else if (chord_type & AUGMENTED) return(note+1);
262          else return(note);
263
264       case (8): /* Ab */
265          return(note);
266
267       case (9): /* A */
268          if (chord_type & MINOR) return(note+1);
269          else if (chord_type & MAJ6) return(note);
270          else if (chord_type & AUGMENTED) return(note+1);
271          else return(note);
272
273       case (10): /* Bb */
274          if (chord_type & MIN7) return(note);
275          else if (chord_type & MAJ7) return(note+1);
276          else if (chord_type & DIMINISHED) return(note-1);
277          else return(note);
278
279       case (11): /* B */
280          if (chord_type & MAJ7) return(note);
281          else if (chord_type & MIN7) return(note-1);
282          else return(note);
283       }
284    return(note); /* Just in case get_intv() screws up (should never get here) */
285    }
286
287
```

We claim:

1. A method for providing a musical performance by an electronic musical instrument comprising the steps of:

a. transposing a song having a plurality of sequences, each of the sequences having a plurality of notes, into the key of C-major and pre-recording the song with its plurality of sequences;

b. organizing the pre-recorded plurality of transposed sequences into a song data structure for playback by the electronic musical instrument;

c. organizing data within the song data structure into a sequence of portions including a header portion, an introductory sequence portion, a normal musical sequence portion, and an ending sequence portion;

d. reading from the song data structure status information stored in the header portion of the data structure;

e. proceeding to a next sequential portion of the sequence of portions;

f. getting a current time command from the header portion;

g. determining if the time to execute a current command has arrived yet;

h. continuing to step i. if the time has arrived, otherwise jumping back to step g.;

i. fetching a current event;

j. determining if a track of the current event is active;

k. continuing to step l. if the track of the current event is active, otherwise jumping back to step g.;

l. determining if a current track resolver of the current event is active;

m. continuing if the current track resolver is active to step n.;

n. selecting a resolver;

o. resolving the current event note into wavetable data; and synthesizing the wavetable data into a musical note.

2. An electronic musical instrument for providing a musical performance comprising:

means for transposing a song having a plurality of sequences, each sequence having a plurality of notes therein into the key of C-major, and pre-recording the song with its plurality of sequences;

means for organizing the pre-recorded plurality of transposed sequences into a song data structure for playback by the electronic musical instrument;

means for organizing data within a data structure of the song into a sequence of portions including a header portion, an introductory sequence portion, a normal musical sequence portion, and an ending sequence portion;

means for reading from the data structure of the song status information stored in the header portion thereof;

means for proceeding to a subsequent portion of the sequence of portions;

means for getting a current time command from the header portion of the sequence of portions;

means for determining if the time to execute the current time command has arrived yet;

means for fetching a current event;

means for determining if a track of the current event is active;

means for determining if a track resolver of the current event is active;

means for selecting a resolver;

means for resolving the current event into wavetable data; and means for synthesizing the wavetable data into a musical note.

3. A method for providing a musical performance by an electronic musical instrument comprising the steps of:

a. transposing a song having a plurality of sequences, each sequence having a plurality of notes into the key of C-major and pre-recording the song and the plurality of sequences;

b. organizing the pre-recorded plurality of transposed sequences into a song data structure for playback by the electronic musical instrument;

c. organizing data within the song data structure into a header portion, an introductory sequence portion, a normal musical sequence portion, and an ending sequence portion;

d. reading from the song data structure status information stored in the header portion of the song data structure;

e. proceeding to a next portion of the sequence;

f. getting a current time command from the sequence header;

g. determining if the time to execute the current command has arrived yet;

h. continuing to step i. if the time has arrived, otherwise jumping back to step g.;

i. fetching the current event;

j. determining if the track of the current event is currently active or if the track is currently muted by a muting mask;

k. continuing to step l. if the track of the current event is active, otherwise jumping back to step g.;

l. determining if a track resolver of the current event is active;

m. continuing if the current track resolver is active to step n.;

n. selecting a resolver;

o. resolving the current event note into wavetable data;

p. synthesizing the wavetable data into a musical note; and q. determining if the playback of the ending portion of the sequence has been completed, if it has been completed the playback of the song data structure is completed and the method terminates, otherwise the method returns to step e.

* * * * *